US011398203B2

(12) United States Patent
Wang

(10) Patent No.: US 11,398,203 B2
(45) Date of Patent: Jul. 26, 2022

(54) METHOD AND DEVICE FOR DRIVING DISPLAY PANEL

(71) Applicant: HKC CORPORATION LIMITED, Shenzhen (CN)

(72) Inventor: Mingliang Wang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/043,852

(22) PCT Filed: Nov. 28, 2018

(86) PCT No.: PCT/CN2018/117959
§ 371 (c)(1),
(2) Date: Sep. 30, 2020

(87) PCT Pub. No.: WO2020/097984
PCT Pub. Date: May 22, 2020

(65) Prior Publication Data
US 2021/0166650 A1 Jun. 3, 2021

(30) Foreign Application Priority Data
Nov. 12, 2018 (CN) ..... 201811338816.X

(51) Int. Cl.
*G09G 3/36* (2006.01)

(52) U.S. Cl.
CPC ..... *G09G 3/3696* (2013.01); *G09G 3/3648* (2013.01); *G09G 2300/0828* (2013.01)

(58) Field of Classification Search
CPC ..... G09G 3/3696; G09G 3/3648; G09G 2300/0828; G09G 3/3655
See application file for complete search history.

(56) References Cited

U.S. PATENT DOCUMENTS 8,736,538 B2 5/2014 Al-dahle
2013/0307761 A1* 11/2013 Kwak ..... G02F 1/136286 345/87
2015/0187318 A1* 7/2015 Kim ..... G02F 1/13624 345/206

FOREIGN PATENT DOCUMENTS

CN 1506719 A 6/2004
CN 101187734 A 5/2008
CN 101290438 A 10/2008
CN 101995722 A 3/2011
CN 103018986 A 4/2013
CN 103323990 A 9/2013
(Continued)

OTHER PUBLICATIONS

International Search Report from International Application No. PCT/CN2018/117959 dated Aug. 12, 2019.

*Primary Examiner* — Sahlu Okebato
(74) *Attorney, Agent, or Firm* — Hauptman Ham, LLP

(57) ABSTRACT

Provided are a drive device and a drive method for a display panel, the drive method comprising: first, acquiring a first common voltage; next, determining a preset threshold according to the first common voltage; and finally, outputting a second common voltage according to the first common voltage and the preset threshold. By means of the present drive method for the display panel, it is only necessary to adjust one common voltage, and another common voltage will automatically follow on the basis of the preset threshold, thus achieving the goal of fixing a voltage difference.

17 Claims, 2 Drawing Sheets

(56) References Cited

FOREIGN PATENT DOCUMENTS

| | | | | | |
|---|---|---|---|---|---|
| CN | 103761951 | A | | 4/2014 | |
| CN | 104376820 | A | | 2/2015 | |
| CN | 105301858 | A | | 2/2016 | |
| CN | 105632450 | A | | 6/2016 | |
| CN | 106249498 | A | | 12/2016 | |
| CN | 106597714 | A | | 4/2017 | |
| CN | 108172188 | A | | 6/2018 | |
| CN | 108415200 | A | | 8/2018 | |
| JP | 2004170721 | A | * | 6/2004 | ..... G09G 3/3406 |

* cited by examiner

METHOD AND DEVICE FOR DRIVING DISPLAY PANEL

CROSS REFERENCE TO RELATED APPLICATIONS

This application claims priority to Chinese Patent Application No. 201811338816.X, filed with the Chinese Patent Office on Nov. 12, 2018 and entitled "METHOD AND DEVICE FOR DRIVING DISPLAY PANEL, AND COMPUTER DEVICE", which is incorporated herein by reference in its entirety.

TECHNICAL FIELD

This application relates to the field of liquid crystal display technologies, and in particular, to a method and device for driving a display panel.

BACKGROUND

The description herein provides only background information related to this application, but does not necessarily constitute the existing technology.

With regard to the problem that a viewing angle of a liquid crystal display panel is not wide enough, it is currently popular to divide a pixel into a main pixel and a sub-pixel, and discharge a voltage of the sub-pixel to a lower level to ensure a brightness performance for a side viewing angle. A dual common-electrode (CF-VCOM, Array-VCOM) design is recently proposed for discharging sub-pixels. By discharging a voltage of a sub-pixel of a liquid crystal to an Array-VCOM voltage, a voltage difference between both ends of the liquid crystal of the sub-pixel is a difference between the Array-VCOM and the CF-VCOM.

Currently, the two VCOM voltages are provided by independent power supplies and are not interlinked, so a fixed voltage difference cannot be achieved.

SUMMARY

On this basis, with regard to the existing problem that a fixed voltage difference cannot be achieved because two VCOM voltages are not interlinked, it is desired to provide a method and device for driving a display panel.

A method for driving a display panel includes:

acquiring a first common voltage;

determining a preset threshold according to the first common voltage; and outputting a second common voltage according to the first common voltage and the preset threshold.

In an embodiment, determining the preset threshold according to the first common voltage includes:

performing an analog-to-digital conversion on the first common voltage to obtain the first target voltage; and determining the preset threshold according to the first target voltage.

In an embodiment, determining the preset threshold according to the first target voltage includes:

determining a grade corresponding to a range of the first target voltage; and determining, according to the grade corresponding to the range of the first target voltage, the preset threshold corresponding to the first target voltage.

In an embodiment, before acquiring a first common voltage, the method further includes:

acquiring identification information about a chip; and determining the first common voltage according to the identification information about the chip.

In an embodiment, the acquiring identification information about the chip refers to acquiring a factory serial number of the chip.

In an embodiment, outputting a second common voltage according to the first common voltage and the preset threshold includes:

acquiring the preset threshold; and performing data processing on the preset threshold and the first common voltage and outputting the second common voltage.

In an embodiment, performing data processing on the preset threshold and the first common voltage and outputting the second common voltage includes:

performing addition processing on the preset threshold and the first common voltage to obtain a second target voltage; and outputting the second common voltage after performing a data conversion on the second target voltage.

In an embodiment, performing data processing on the preset threshold and the first common voltage and outputting the second common voltage includes:

performing multiplication processing on the preset threshold and the first common voltage to obtain a second target voltage; and outputting the second common voltage after performing a data conversion on the second target voltage.

In an embodiment, outputting the second common voltage after performing a data conversion on the second target voltage includes:

performing a digital-to-analog conversion on the second target voltage based on a preset reference voltage; and obtaining the second common voltage and outputting the second common voltage.

A method for driving a display panel includes:

acquiring identification information about a chip and determining a first common voltage according to the identification information about the chip;

performing an analog-to-digital conversion on the first common voltage to obtain the first target voltage;

determining a preset threshold according to the first target voltage; and outputting a second common voltage according to the first common voltage and the preset threshold.

In an embodiment, determining the preset threshold according to the first target voltage includes:

determining a grade corresponding to a range of the first target voltage; and determining, according to the grade corresponding to the range of the first target voltage, the preset threshold corresponding to the first target voltage.

In an embodiment, the acquiring identification information about a chip refers to acquiring a factory serial number of the chip.

In an embodiment, outputting the second common voltage according to the first common voltage and the preset threshold includes:

acquiring the preset threshold; and performing data processing on the preset threshold and the first common voltage and outputting the second common voltage.

In an embodiment, performing data processing on the preset threshold and the first common voltage and outputting the second common voltage includes:

performing addition processing on the preset threshold and the first common voltage to obtain a second target voltage; and outputting the second common voltage after performing a data conversion on the second target voltage.

In an embodiment, outputting the second common voltage after performing a data conversion on the second target voltage includes:

performing a digital-to-analog conversion on the second target voltage based on a preset reference voltage; and obtaining the second common voltage and outputting the second common voltage.

In an embodiment, performing data processing on the preset threshold and the first common voltage and outputting the second common voltage includes:

performing multiplication processing on the preset threshold and the first common voltage to obtain a second target voltage; and outputting the second common voltage after performing a data conversion on the second target voltage.

In an embodiment, outputting the second common voltage after performing the data conversion on the second target voltage includes:

performing a digital-to-analog conversion on the second target voltage based on a preset reference voltage; and obtaining the second common voltage and outputting the second common voltage.

A device for driving a display panel includes:

an acquisition module configured to acquire a first common voltage;

an analysis module electrically connected to the acquisition module and configured to determine a preset threshold according to the first common voltage; and a processing and outputting module electrically connected to the acquisition module and the analysis module respectively and configured to output a second common voltage according to the first common voltage and the preset threshold.

In an embodiment, the analysis module is a processor.

In an embodiment, the processing and outputting module is a microcontroller unit.

It can be known from the above solutions that the method for driving a display panel as described above includes: firstly acquiring a first common voltage; secondly determining a preset threshold according to the first common voltage; and finally outputting a second common voltage according to the first common voltage and the preset threshold. By means of such method, a fixed voltage difference can be achieved by adjusting only one common voltage, as the other common voltage will follow based on the preset threshold. In addition, this application can also improve work efficiency.

BRIEF DESCRIPTION OF THE DRAWINGS

To describe the technical solutions in the embodiments of this application or in the prior art more clearly, the following briefly introduces the accompanying drawings required for describing the embodiments or the prior art. Apparently, the accompanying drawings in the following description show merely the embodiments of this application, and a person of ordinary skill in the art may still derive other drawings from these accompanying drawings without creative efforts.

LIST OF REFERENCE NUMERALS

10 Device for driving a display panel
100 Acquisition module
200 Analysis module
210 Processor
300 Outputting module
310 Microcontroller unit

DETAILED DESCRIPTION OF THE EMBODIMENTS

The following clearly and completely describes the technical solutions in the embodiments of this application with reference to the accompanying drawings in the embodiments of this application. Apparently, the described embodiments are some embodiments of this application rather than all of the embodiments. All other embodiments obtained by a person of ordinary skill in the art based on the embodiments of this application without creative efforts shall fall within the protection scope of this application.

Embodiments of this application disclose a method and device for driving a display panel. A fixed voltage difference can be achieved by adjusting only one common voltage, as the other common voltage will automatically follow.

Figure 1:
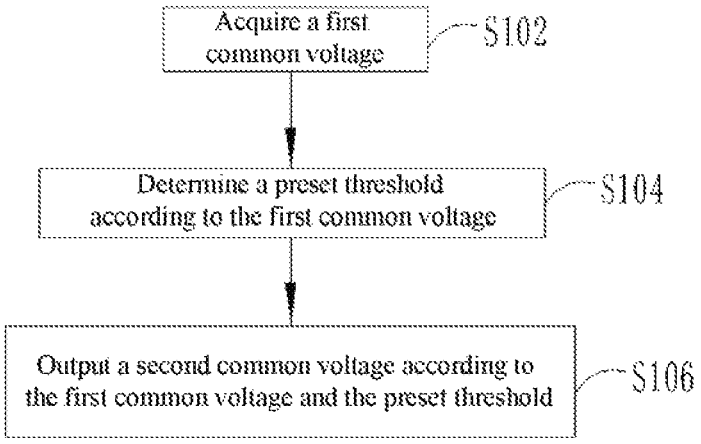
FIG. 1 is a flowchart of a method for driving a display panel provided in accordance with an embodiment of this application.

Referring to FIG. 1, an embodiment of this application provides a method for driving a display panel including the following steps.

S102: A first common voltage is acquired.

It can be understood that a specific value of the first common voltage is not defined particularly, as long as there's a voltage output. In an embodiment, the first common voltage may be 5 V. In an embodiment, the first common voltage may be 7 V. The specific value of the first common voltage may be set as needed.

It can be understood that a manner of acquiring the first common voltage is not limited, as long as the first common voltage can be acquired. In an embodiment, the first common voltage may be acquired using a voltmeter. In an embodiment, the first common voltage may also be acquired using an oscilloscope. The manner of acquiring the first common voltage may be selected as needed. In an embodiment, the first common voltage is an output voltage of a first chip.

S104: A preset threshold is determined according to the first common voltage.

It can be understood that a manner of determining the preset threshold according to the first common voltage is not limited, as long as the preset threshold can be determined according to the first common voltage. In an embodiment, the preset threshold may be determined through a mapping relation between the first common voltage and the preset threshold. In an embodiment, when the first common voltage is a voltage between 5 V and 6 V, the preset threshold may be 0.5 V. In an embodiment, when the first common voltage is a voltage between 6 V and 7 V, the preset threshold may be 1.5 V. The specific mapping relation between the first common voltage and the preset threshold may be selected as needed. In an embodiment, the preset threshold may also be a fixed value, for example, the preset threshold is 0.5 V or 1 V, etc. In an embodiment, the preset threshold may be determined by a first processor according to the first common voltage.

S106: A second common voltage is output according to the first common voltage and the preset threshold.

The second common voltage is output according to the first common voltage and the preset threshold. In particular, the second common voltage is output after data analysis and processing is performed on the first common voltage and the preset threshold. The data analysis and processing may be addition processing or multiplication processing. In an embodiment, when the data analysis and processing is the addition processing, the first common voltage is added to the preset threshold (i.e., addition processing), and the second common voltage is output after a digital-to-analog conversion is performed on the resulting data. In an embodiment, the second common voltage may be output by a first microcontroller according to the first common voltage and the preset threshold. In an embodiment, the second common voltage is an output voltage of a second chip.

In an embodiment, when the data analysis and processing is the multiplication processing, the first common voltage is multiplied by the preset threshold (i.e., multiplication processing), and the second common voltage is output after a digital-to-analog conversion is performed on the resulting data. A value of the second common voltage can be determined according to values of the first common voltage and the preset threshold, regardless of whether the addition processing or the multiplication processing is employed. That is, when one common voltage is adjusted, the other common voltage will automatically follow, which makes adjustment time-saving and effort-saving.

In this embodiment, by means of such method, a fixed voltage difference can be achieved by adjusting only one common voltage, as the other common voltage will follow based on the preset threshold. In addition, this application can also improve work efficiency.

In an embodiment, the step of determining a preset threshold according to the first common voltage includes: performing an analog-to-digital conversion on the first common voltage to obtain the first target voltage; and determining the preset threshold according to the first target voltage.

It can be understood that a manner of performing the analog-to-digital conversion on the first common voltage is not limited, as long as the first common voltage is converted from an analog voltage signal to a digital voltage signal. In an embodiment, a signal conversion may be performed on the first common voltage using an analog-to-digital converter. In particular, the analog-to-digital converter converts the first common voltage from the analog voltage signal to the digital voltage signal according to a preset reference criterion. In an embodiment, the preset reference criterion may be a maximum convertible signal size.

In an embodiment, the step of determining the preset threshold according to the first target voltage includes: determining a grade corresponding to a range of the first target voltage; and determining, according to the grade corresponding to the range of the first target voltage, the preset threshold corresponding to the first target voltage.

In an embodiment, the grade corresponding to the range may include grade I, grade II and grade III. In particular, the grade I corresponds to a range in which the voltage is between 5 V and 6 V, and in this case the preset threshold is 0.5 V. The grade II corresponds to a range in which the voltage is between 6 V and 7 V, and in this case the preset threshold is 1 V. The grade HMI corresponds to a range in which the voltage is between 7 V and 8 V, and in this case the preset threshold is 1.5 V. In an embodiment, when the grade corresponding to the range of the first target voltage is determined to be the grade I, the preset threshold corresponding to the first target voltage may be determined to be 0.5 V. In an embodiment, when the grade corresponding to the range of the first target voltage is determined to be the grade II, the preset threshold corresponding to the first target voltage may be determined to be 1 V. In an embodiment, the grade corresponding to the range may include grade I, grade II, grade III and grade IV, etc. A specific voltage range for a specific grade may be set as needed. Similarly, a magnitude of the preset threshold corresponding to a specific grade may also be set as needed.

In an embodiment, before the step of acquiring a first common voltage, the method further includes: acquiring identification information about a chip; and determining the first common voltage according to the identification information about the chip. In an embodiment, the identification information about the chip may be a factory serial number of the chip. In an embodiment, the identification information about the chip may be a specific model of the chip, or others. In an embodiment, the identification information about the chip may also be a user-defined identification, such as a chip identification of a successive natural number. A chip that outputs the first common voltage may be determined according to the identification information about the chip.

In an embodiment, the step of outputting a second common voltage according to the first common voltage and the preset threshold includes: acquiring the preset threshold; and performing data processing on the preset threshold and the first common voltage and outputting the second common voltage.

It can be understood that a value of the preset threshold is not defined, as long as the second common voltage is output according to the preset threshold and the first common voltage. In an embodiment, the value of the preset threshold may be set to 0.7 V. In an embodiment, the value of the preset threshold may be set to 1.2 V. The specific value of the preset threshold may be set as needed.

Performing data processing on the preset threshold and the first common voltage refers to performing addition processing or multiplication processing on the preset threshold and the first common voltage, and outputting the second common voltage according to a processing result. That is, the second common voltage can be determined according to the values of the first common voltage and the preset threshold.

In an embodiment, the step of performing data processing on the preset threshold and the first common voltage and outputting the second common voltage includes: performing addition processing or multiplication processing on the preset threshold and the first common voltage to obtain a second target voltage; and outputting the second common voltage after performing a data conversion on the second target voltage. Performing a data conversion on the second target voltage refers to converting the second target voltage from a digital signal to an analog signal. The resulting analog signal output is the second common voltage.

In an embodiment, the step of outputting the second common voltage after performing a data conversion on the second target voltage includes: performing a digital-to-analog conversion on the second target voltage based on a preset reference voltage; and obtaining the second common voltage and outputting the second common voltage.

In an embodiment, a value of the preset reference voltage is not defined particularly, as long as a digital-to-analog conversion can be performed on the second target voltage based on the preset reference voltage. In an embodiment, the value of the preset reference voltage may be 13 V. In an embodiment, the value of the preset reference voltage may be 15 V. In an embodiment, a digital-to-analog converter may be used to convert the second target voltage from the digital voltage signal to the analog voltage signal.

Figure 2:
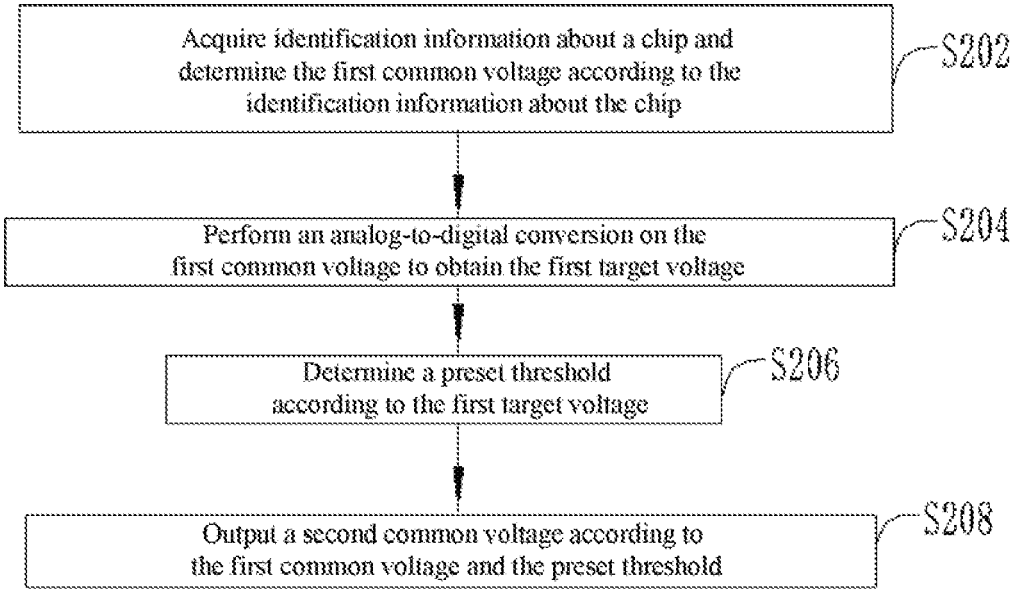
FIG. 2 is a flowchart of a method for driving a display panel provided in accordance with another embodiment of this application.

Referring to FIG. 2, an embodiment of this application provides a method for driving a display panel, including the following steps.

S202: Identification information about a chip is acquired and the first common voltage is determined according to the identification information about the chip.

It can be understood that a specific value of the first common voltage is not defined particularly, as long as there's a voltage output. In an embodiment, the first common voltage may be 5 V. In an embodiment, the first common voltage may be 7 V. The specific value of the first common voltage may be set as needed. It can be understood that a manner of acquiring the first common voltage is not limited, as long as the first common voltage can be acquired.

In an embodiment, the identification information about the chip may be a factory serial number of the chip. In an embodiment, the identification information about the chip may be a specific model of the chip, etc. In an embodiment, the identification information about the chip may also be a user-defined identification, such as a chip identification of a successive natural number. A chip that outputs the first common voltage may be determined according to the identification information about the chip.

S204: An analog-to-digital conversion is performed on the first common voltage to obtain the first target voltage.

It can be understood that a manner of performing the analog-to-digital conversion on the first common voltage is not limited, as long as the first common voltage is converted from an analog voltage signal to a digital voltage signal. In an embodiment, a signal conversion may be performed on the first common voltage using an analog-to-digital converter. In particular, the analog-to-digital converter converts the first common voltage from the analog voltage signal to the digital voltage signal according to a preset reference criterion. In an embodiment, the preset reference criterion may be a maximum convertible signal size.

S206: A preset threshold is determined according to the first target voltage.

It can be understood that a manner of determining the preset threshold according to the first target voltage is not limited, as long as the preset threshold can be determined according to the first target voltage. In an embodiment, the preset threshold may be determined through a mapping relation between the first target voltage and the preset threshold. In an embodiment, when the first target voltage is a voltage between 5 V and 6 V, the preset threshold may be 0.5 V. In an embodiment, when the first target voltage is a voltage between 6 V and 7 V, the preset threshold may be 1.5 V. The specific mapping relation between the first target voltage and the preset threshold may be selected as needed. In an embodiment, the preset threshold may also be a fixed value, for example, the preset threshold is 0.5 V or 1 V, etc. In an embodiment, the preset threshold may be determined by a first processor according to the first target voltage.

S208: A second common voltage is output according to the first common voltage and the preset threshold.

The second common voltage is output according to the first common voltage and the preset threshold. In particular, the second common voltage is output after data analysis and processing is performed on the first common voltage and the preset threshold. The data analysis and processing may be addition processing or multiplication processing. In an embodiment, when the data analysis and processing is the addition processing, the first common voltage is added to the preset threshold (i.e., addition processing), and the second common voltage is output after a digital-to-analog conversion is performed on the resulting data.

In an embodiment, when the data analysis and processing is the multiplication processing, the first common voltage is multiplied by the preset threshold (i.e., multiplication processing), and the second common voltage is output after a digital-to-analog conversion is performed on the resulting data. A value of the second common voltage can be determined according to values of the first common voltage and the preset threshold, regardless of whether the addition processing or the multiplication processing is employed. That is, when one common voltage is adjusted, the other common voltage will automatically follow, which makes adjustment time-saving and effort-saving.

In this embodiment, by means of such method, a fixed voltage difference can be achieved by adjusting only one common voltage, as the other common voltage will follow based on the preset threshold. In addition, this application can also improve work efficiency.

According to this application, in practical use:

Firstly, an analog-to-digital conversion is performed on the acquired first common voltage to convert an analog voltage V of the first common voltage to a digital voltage V representation corresponding to the analog voltage V. For example, a 7 bit code is set, with the former 3 bits representing a voltage value at an integer place, and the latter 4 bits representing a voltage value at a decimal place. This code is simply a digital representation. The digital voltage value V is then added to the preset threshold (ΔV) to obtain a digital voltage value V+ΔV of the second common voltage. Next, an operation and a conversion are performed according to a design principle of a hardware circuit, i.e., $$(\mathrm{V}+\Delta V)=\mathrm{code}*\frac{VREF}{2^m},\ \text{then code}=(\mathrm{V}+\Delta V)*\frac{2^m}{VREF},$$

which enables a conversion of this pure digital V+ΔV to an actually available code. Secondly, this application performs a digital-to-analog conversion on the code, and finally outputs the second common voltage according to the first common voltage and the preset threshold, thus maintaining a constant voltage difference. The first common voltage acquired in accordance with the present invention is an actual output voltage of a chip, and accuracy in specific applications will be higher.

To sum up, by means of the method of this application, a fixed voltage difference can be achieved by adjusting only one common voltage, as the other common voltage will follow based on the preset threshold. In addition, this application can also improve work efficiency.

Figure 3:
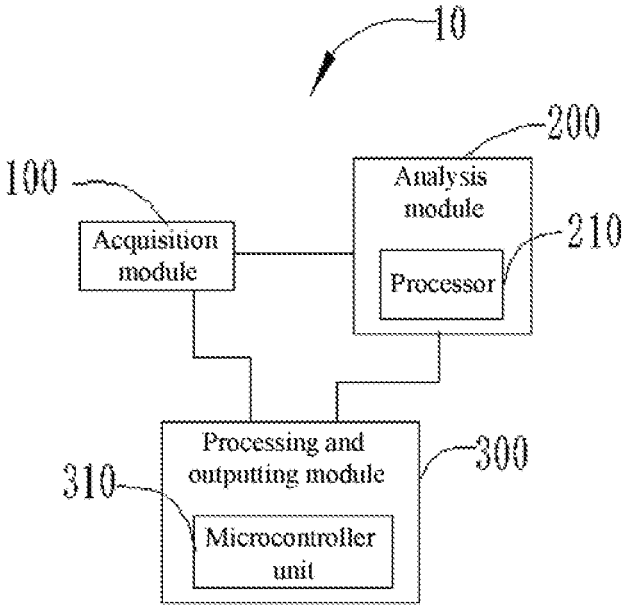
FIG. 3 is a structural block diagram of a device for driving a display panel provided in accordance with an embodiment of this application.

Referring to FIG. 3, an embodiment of this application provides a device 10 for driving a display panel, including an acquisition module 100, an analysis module 200 and a processing and outputting module 300. The acquisition module 100 is configured to acquire a first common voltage. The analysis module 200 is electrically connected to the acquisition module 100. The analysis module 200 is configured to determine a preset threshold according to the first common voltage. The processing and outputting module 300 is electrically connected to the acquisition module 100 and the analysis module 200 respectively. The processing and outputting module 300 is configured to output a second common voltage according to the first common voltage and the preset threshold.

In an embodiment, the analysis module 200 may employ a processor 210. The analysis module 200 may also employ other device, as long as a capability to determine the preset threshold according to the first common voltage is provided. In an embodiment, the processing and outputting module 300 may employ a microcontroller unit (MCU) 310. The MCU outputs the second common voltage according to the first common voltage and the preset threshold. The processing and outputting module 300 may also employ other device, such as a processor, etc.

Finally, it should be noted that the relational terms herein such as first and second are used only to differentiate an entity or operation from another entity or operation, and do not require or imply any actual relationship or sequence between these entities or operations. Moreover, the terms "include", "comprise", and any variants thereof are intended to cover a non-exclusive inclusion. Therefore, in the context of a process, method, object, or device that includes a series of elements, the process, method, object, or device not only includes such elements, but also includes other elements not specified expressly, or may include inherent elements of the process, method, object, or device. Without further limitation, the element defined by a phrase "include one . . . " does not exclude other same elements in the process, method, article or device which include the element.

It should be noted that the embodiments in this specification are all described in a progressive manner. Description of each of the embodiments focuses on differences from other embodiments, and reference may be made to each other for the same or similar parts among respective embodiments.

The above description of the disclosed embodiments enables persons skilled in the art to implement or use this application. Various modifications to these embodiments are obvious to persons skilled in the art, the general principles defined herein may be implemented in other embodiments without departing from the spirit and scope of this application. Therefore, this application is not limited to these embodiments illustrated herein, but needs to conform to the broadest scope consistent with the principles and novel features disclosed herein.

What is claimed is:

1. A method for driving a display panel, the method comprising:

acquiring a first common voltage;

performing an analog-to-digital conversion on the first common voltage to obtain a first target voltage;

determining a grade corresponding to an amplitude range of the first target voltage, wherein different grades correspond to different preset voltage thresholds;

determining, according to the grade corresponding to the amplitude range of the first target voltage, a preset voltage threshold corresponding to the first target voltage; and outputting a second common voltage according to the first common voltage and the preset voltage threshold;

wherein the display panel comprises pixels each of which is divided into a main pixel and a sub-pixel and a voltage difference between both ends of a liquid crystal of the sub-pixel is a difference between the second common voltage and the first common voltage.

2. The method according to claim 1, wherein before acquiring the first common voltage, the method further comprises:

acquiring identification information about a chip; and determining the first common voltage according to the identification information about the chip.

3. The method according to claim 2, wherein the acquiring identification information about the chip refers to acquiring a factory serial number of the chip.

4. The method according to claim 1, wherein outputting the second common voltage according to the first common voltage and the preset voltage threshold comprises:

acquiring the preset voltage threshold; and performing data processing on the preset voltage threshold and the first common voltage and outputting the second common voltage.

5. The method according to claim 4, wherein performing data processing on the preset voltage threshold and the first common voltage and outputting the second common voltage comprises:

performing addition processing on the preset voltage threshold and the first common voltage to obtain a second target voltage; and outputting the second common voltage after performing a data conversion on the second target voltage.

6. The method according to claim 4, wherein performing data processing on the preset voltage threshold and the first common voltage and outputting the second common voltage comprises:

performing multiplication processing on the preset voltage threshold and the first common voltage to obtain a second target voltage; and outputting the second common voltage after performing a data conversion on the second target voltage.

7. The method according to claim 6, wherein outputting the second common voltage after performing a data conversion on the second target voltage comprises:

performing a digital-to-analog conversion on the second target voltage based on a preset reference voltage, to obtain the second common voltage; and outputting the second common voltage.

8. A method for driving a display panel, the method comprising:

acquiring identification information about a chip and determining a first common voltage according to the identification information about the chip;

performing an analog-to-digital conversion on the first common voltage to obtain the first target voltage;

determining a grade corresponding to an amplitude range of the first target voltage, wherein different grades correspond to different preset voltage thresholds;

determining, according to the grade corresponding to the amplitude range of the first target voltage, a preset voltage threshold corresponding to the first target voltage; and outputting a second common voltage according to the first common voltage and the preset voltage threshold;

wherein the display panel comprises pixels each of which is divided into a main pixel and a sub-pixel and a voltage difference between both ends of a liquid crystal of the sub-pixel is a difference between the second common voltage and the first common voltage.

9. The method according to claim 8, wherein the acquiring identification information about the chip refers to acquiring a factory serial number of the chip.

10. The method according to claim 8, wherein outputting the second common voltage according to the first common voltage and the preset voltage threshold comprises:

acquiring the preset voltage threshold; and performing data processing on the preset voltage threshold and the first common voltage and outputting the second common voltage.

11. The method according to claim 10, wherein performing data processing on the preset voltage threshold and the first common voltage and outputting the second common voltage comprises:

performing addition processing on the preset voltage threshold and the first common voltage to obtain a second target voltage; and outputting the second common voltage after performing a data conversion on the second target voltage.

12. The method according to claim 11, wherein outputting the second common voltage after performing a data conversion on the second target voltage comprises:

performing a digital-to-analog conversion on the second target voltage based on a preset reference voltage, to obtain the second common voltage; and outputting the second common voltage.

13. The method according to claim 10, wherein performing data processing on the preset voltage threshold and the first common voltage and outputting the second common voltage comprises:

performing multiplication processing on the preset voltage threshold and the first common voltage to obtain a second target voltage; and outputting the second common voltage after performing a data conversion on the second target voltage.

14. The method according to claim 13, wherein outputting the second common voltage after performing a data conversion on the second target voltage comprises:

performing a digital-to-analog conversion on the second target voltage based on a preset reference voltage, to obtain the second common voltage; and outputting the second common voltage.

15. A device for driving a display panel, the device comprising:

an acquisition module configured to acquire a first common voltage;

an analysis module electrically connected to the acquisition module and configured to:

perform an analog-to-digital conversion on the first common voltage to obtain a first target voltage;

determine a grade corresponding to an amplitude range of the first target voltage, wherein different grades correspond to different preset voltage thresholds; and determine, according to the grade corresponding to the amplitude range of the first target voltage, a preset voltage threshold corresponding to the first target voltage; and a processing and outputting module electrically connected to the acquisition module and the analysis module respectively and configured to output a second common voltage according to the first common voltage and the preset voltage threshold;

wherein the display panel comprises pixels each of which is divided into a main pixel and a sub-pixel and a voltage difference between both ends of a liquid crystal of the sub-pixel is a difference between the second common voltage and the first common voltage.

16. The device according to claim 15, wherein the analysis module includes a processor.

17. The device according to claim 15, wherein the processing and outputting module includes a microcontroller unit.

* * * * *